US011415912B2

(12) United States Patent
Kakutani et al.

(10) Patent No.: US 11,415,912 B2
(45) Date of Patent: Aug. 16, 2022

(54) DEVELOPING CARTRIDGE INCLUDING AGITATOR CONFIGURED TO CONTACT PERIPHERAL SURFACE OF SUPPLY ROLLER

(71) Applicant: BROTHER KOGYO KABUSHIKI KAISHA, Nagoya (JP)

(72) Inventors: Hotaka Kakutani, Kiyosu (JP); Kazuaki Ooka, Nagoya (JP); Kengo Yada, Seki (JP); Ayaka Komori, Nagoya (JP); Shota Iriyama, Toyokawa (JP); Keigo Nakajima, Nagoya (JP); Junichi Hashimoto, Toyohashi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/160,939

(22) Filed: Jan. 28, 2021

(65) Prior Publication Data

US 2021/0255567 A1 Aug. 19, 2021

(30) Foreign Application Priority Data

Feb. 14, 2020 (JP) ..... JP2020-023415

(51) Int. Cl.
*G03G 15/10* (2006.01)

(52) U.S. Cl.
CPC ..... *G03G 15/104* (2013.01); *G03G 2215/066* (2013.01); *G03G 2215/085* (2013.01)

(58) Field of Classification Search
CPC ..... G03G 15/0822; G03G 15/0808; G03G 15/0887; G03G 15/0889; G03G 15/0891
See application file for complete search history.

(56) References Cited

U.S. PATENT DOCUMENTS

| | | | | |
|---|---|---|---|---|
| 8,712,294 | B2 * | 4/2014 | Koyama | G03G 15/0889 399/256 |
| 2005/0117920 | A1 | 6/2005 | Ogata et al. | |
| 2012/0093541 | A1 | 4/2012 | Komyama et al. | |
| 2018/0181023 | A1 * | 6/2018 | Jang | G03G 15/0868 |
| 2020/0103786 | A1 | 4/2020 | Ooka et al. | |

FOREIGN PATENT DOCUMENTS

| | | | |
|---|---|---|---|
| JP | 7-325452 | A | 12/1995 |
| JP | 2005031299 | A * | 2/2005 |
| JP | 2012-088403 | A | 5/2012 |
| JP | 2020-052311 | A | 4/2020 |

* cited by examiner

*Primary Examiner* — Walter L Lindsay, Jr.
*Assistant Examiner* — Andrew V Do
(74) *Attorney, Agent, or Firm* — Merchant & Gould P.C.

(57) ABSTRACT

A developing cartridge includes a casing, a developing roller, a supply roller, a first agitator and a second agitator. The casing is configured to accommodate toner therein. The supply roller is configured to supply the toner to the developing roller. The first agitator is configured to agitate the toner in the casing. The second agitator is configured to agitate the toner in the casing. The second agitator is positioned between the first agitator and the supply roller. The second agitator includes a blade having a tip end configured to contact a peripheral surface of the supply roller.

15 Claims, 7 Drawing Sheets

DEVELOPING CARTRIDGE INCLUDING AGITATOR CONFIGURED TO CONTACT PERIPHERAL SURFACE OF SUPPLY ROLLER

CROSS REFERENCE TO RELATED APPLICATION

This application claims priority from Japanese Patent Application No. 2020-023415 filed Feb. 14, 2020. The entire content of the priority application is incorporated herein by reference.

TECHNICAL FIELD

The present disclosure relates to a developing cartridge including an agitator configured to agitate toner accommodated in a casing.

BACKGROUND

There has been known a developing cartridge including: a casing for storing toner therein; and a developing roller rotatably positioned in the casing; a supply roller for supplying the toner to the developing roller. This developing cartridge includes: a first agitator including a blade for agitating the toner and rotatably supported by the casing; and a second agitator including a blade for toner agitation and rotatably supported by the casing at a position between the first agitator and the supply roller.

SUMMARY

However, providing the first and second agitators in the casing may not necessarily lead to sufficient agitation of the toner. Insufficient toner agitation may cause aggregation of toner on the supply roller, for example, and such aggregated toner may move from the supply roller to the developing roller. In this case, if a layer-thickness regulating blade scrapes the aggregated toner from the developing roller, an amount of the toner left on the developing roller becomes excessively reduced, which may result in printing blur. Particularly, in a developing cartridge where the developing roller is positioned below the supply roller in an attached posture of the developing cartridge to an image-forming apparatus, the aggregation of toner is likely to occur on the supply roller due to gravity effect, and the above described tendency becomes outstanding.

In view of the foregoing, it is an object of the disclosure to provide a developing cartridge capable of restraining toner from being aggregated on the supply roller and restraining the aggregated toner from moving to the developing roller.

In order to attain the above and other objects, according to one aspect, the disclosure provides a developing cartridge including a casing, a developing roller, a supply roller, a first agitator, and a second agitator. The casing is configured to accommodate toner therein. The supply roller is configured to supply the toner to the developing roller. The first agitator is configured to agitate the toner in the casing. The second agitator is configured to agitate the toner in the casing. The second agitator is positioned between the first agitator and the supply roller. The second agitator includes a blade having a tip end configured to contact a peripheral surface of the supply roller.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

Hereinafter, one embodiment of the present disclosure will be described with reference to the accompanying drawings. In the following description, an overall structure of an image-forming apparatus 1 will be described first, and, thereafter, features of the present disclosure will be described.

Figure 1:
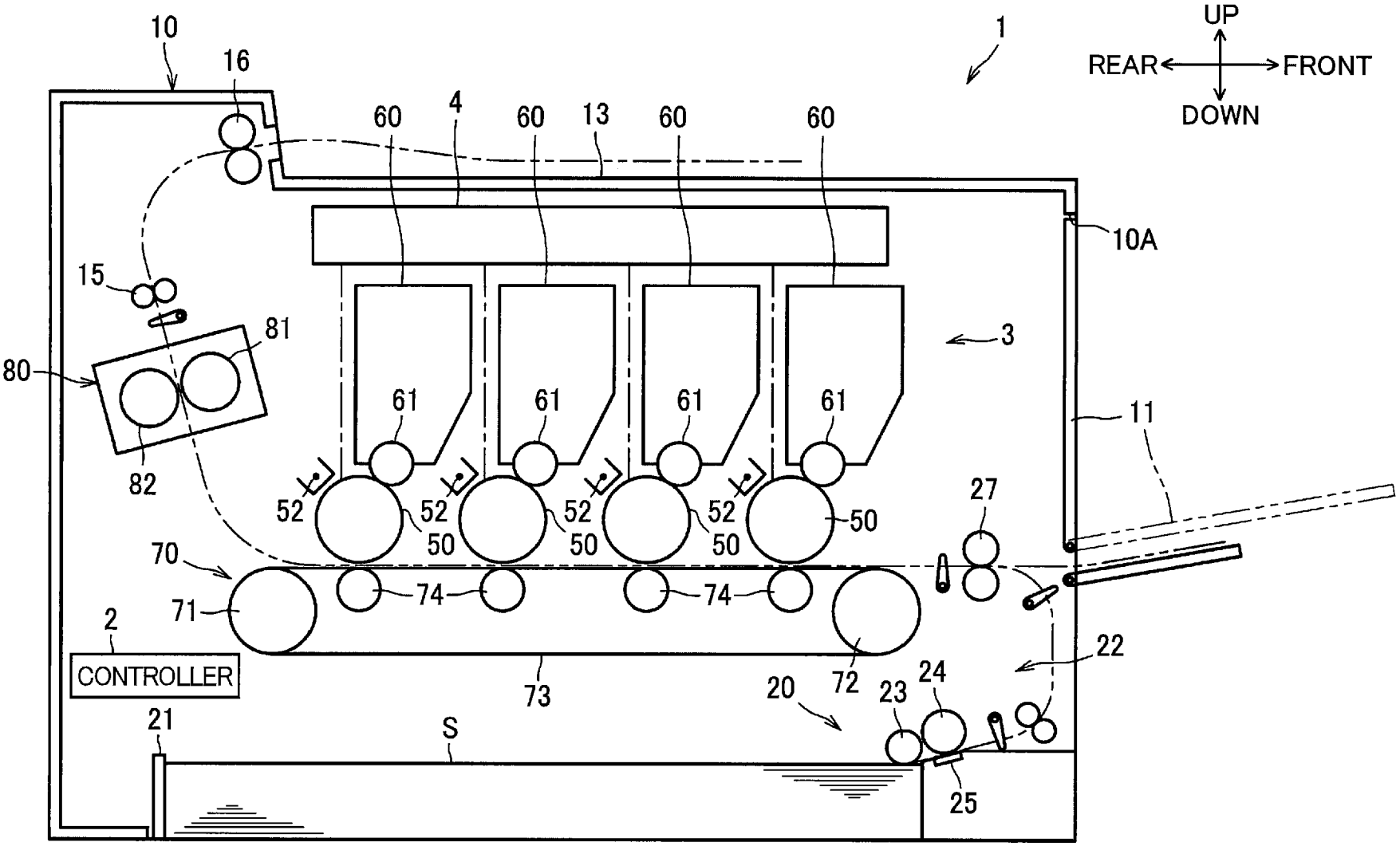
FIG. 1 is a schematic view of an image-forming apparatus to which a developing cartridge according to one embodiment is attachable.

The image-forming apparatus 1 according to the embodiment is a color printer. As illustrated in FIG. 1, the image-forming apparatus 1 includes a housing 10, a cover 11, a sheet supply unit 20, an image-forming unit 3, and a controller 2.

Hereinafter, throughout the specification, a right side, a left side, an upper side, and a lower side in FIG. 1 will be referred to as a front side, a rear side, an upper side, and a lower side of the image-forming apparatus 1, respectively. Specifically, a direction for pulling out a sheet tray 21 (described later) is defined is a frontward direction (toward the right in FIG. 1). Further, a near side and a far side in FIG. 1 will be referred to as a left side and a right side of the image-forming apparatus 1, respectively.

The housing 10 has a front end formed with a first opening 10A. The cover 11 is pivotally movable relative to the housing 10 between a closed position closing the first opening 10A (as indicated by a solid line) and an open position opening the first opening 10A (as indicated by a two-dotted chain line). The housing 10 has an upper surface region serving as a discharge tray 13.

The sheet supply unit 20 is positioned at a lower internal portion of the housing 10. The sheet supply unit 20 includes the sheet tray 21 for accommodating sheets S, and a sheet supply mechanism 22 configured to supply one sheet S from the sheet tray 21 toward the image-forming unit 3. The sheet tray 21 is detachable from the housing 10 by being pulled out forward (toward the right in FIG. 1). The sheet supply mechanism 22 is positioned at a front internal portion of the housing 10. The sheet supply mechanism 22 includes a sheet supply roller 23, a separation roller 24, a separation pad 25, and a pair of registration rollers 27.

In the sheet supply unit 20, the sheet(s) S accommodated in the sheet tray 21 is fed by the sheet supply roller 23, and then the sheet(s) S is separated one by one by the separation roller 24 and the separation pad 25. Thereafter, a position of a leading edge of each sheet S is regulated by the registration rollers 27 during a halt of the rotations of the registration rollers 27, and then, the sheet S is supplied to the image-forming unit 3 by the rotations of the registration rollers 27.

The image-forming unit 3 includes an exposure device 4, a plurality of (four) photosensitive drums 50, a plurality of (four) developing cartridges 60, a plurality of (four) chargers 52, a conveying unit 70, and a fixing device 80. Each of the developing cartridge 60 includes a developing roller 61.

The exposure device 4 includes a laser diode, a deflector, lenses, and mirrors those not illustrated. The exposure device 40 is configured to expose peripheral surfaces of the respective photosensitive drums 50 to a plurality of laser beams for scanning the peripheral surfaces of the respective photosensitive drums 50.

The plurality of developing cartridges 60 is provided in one-to-one correspondence with the plurality of photosensitive drums 50. The plurality of chargers 52 is also provided in one-to-one correspondence with the plurality of photosensitive drums 50.

The conveying unit 70 is positioned between the sheet tray 21 and the plurality of photosensitive drums 50. The conveying unit 70 includes a drive roller 71, a driven roller 72, a conveyer belt 73, and four transfer rollers 74. The conveyer belt 73 is an endless belt mounted over the drive roller 71 and the driven roller 72 under tension. The conveyer belt 73 has an outer surface (upper outer surface) facing the respective photosensitive drums 50. Each transfer roller 74 is positioned inside a loop of the conveyer belt 73, and is configured to nip the conveyer belt 73 in cooperation with a corresponding one of the photosensitive drums 50. In the conveyer unit 70, the sheet S mounted on the upper outer surface of the conveyer belt 73 is conveyed by the movement of the conveyer belt 73. At this time, toner images formed on the plurality of the photosensitive drums 50 are transferred onto the sheet S.

The fixing device 80 is positioned rearward of the plurality of photosensitive drums 50 and the conveying unit 70. The fixing device 80 includes a heat roller 81, and a pressure roller 82 facing the heat roller 81. Further, a pair of conveying rollers 15 is positioned above the fixing device 80, and a pair of discharge rollers 16 is positioned above the conveying rollers 15.

In the image-forming unit 3 configured as above, after the chargers 52 uniformly charge the peripheral surfaces of the respective photosensitive drums 50, the peripheral surface of each photosensitive drum 50 is exposed to laser light by the exposure device 40, thereby an electrostatic latent image corresponding to image data is formed on the peripheral surface of each photosensitive drum 50.

In the meantime, toner accommodated in each developing cartridge 60 is carried on a peripheral surface of the corresponding developing roller 61, and the toner is supplied to the electrostatic latent image formed on the corresponding photosensitive drum 50 when the developing roller 61 contacts the photosensitive drum 50. Thus, a toner image is formed on each of the photosensitive drums 50.

Subsequently, the toner images on the respective photosensitive drums 50 are transferred to the sheet S while the sheet S on the conveyer belt 73 passes between each photosensitive drum 50 and the corresponding transfer roller 74. As the sheet S then passes between the heat roller 81 and the pressure roller 82, the toner images are thermally fixed to the sheet S.

The sheet S is then discharged onto the discharging tray 13 by the conveying rollers 15 and the discharge rollers 16.

Next, a structure of each developing cartridge 60 will be described in detail.

In the following description, an extending direction of a developing axis 61X (described later) of the developing roller 61 will be referred to as a "first direction". Further, a direction crossing the first direction and connecting the developing axis 61X to a first agitator axis 31X of a first agitator 30 (described later) will be referred to as a "second direction". Specifically, in the present disclosure, the second direction is perpendicular to the first direction.

Figure 2:
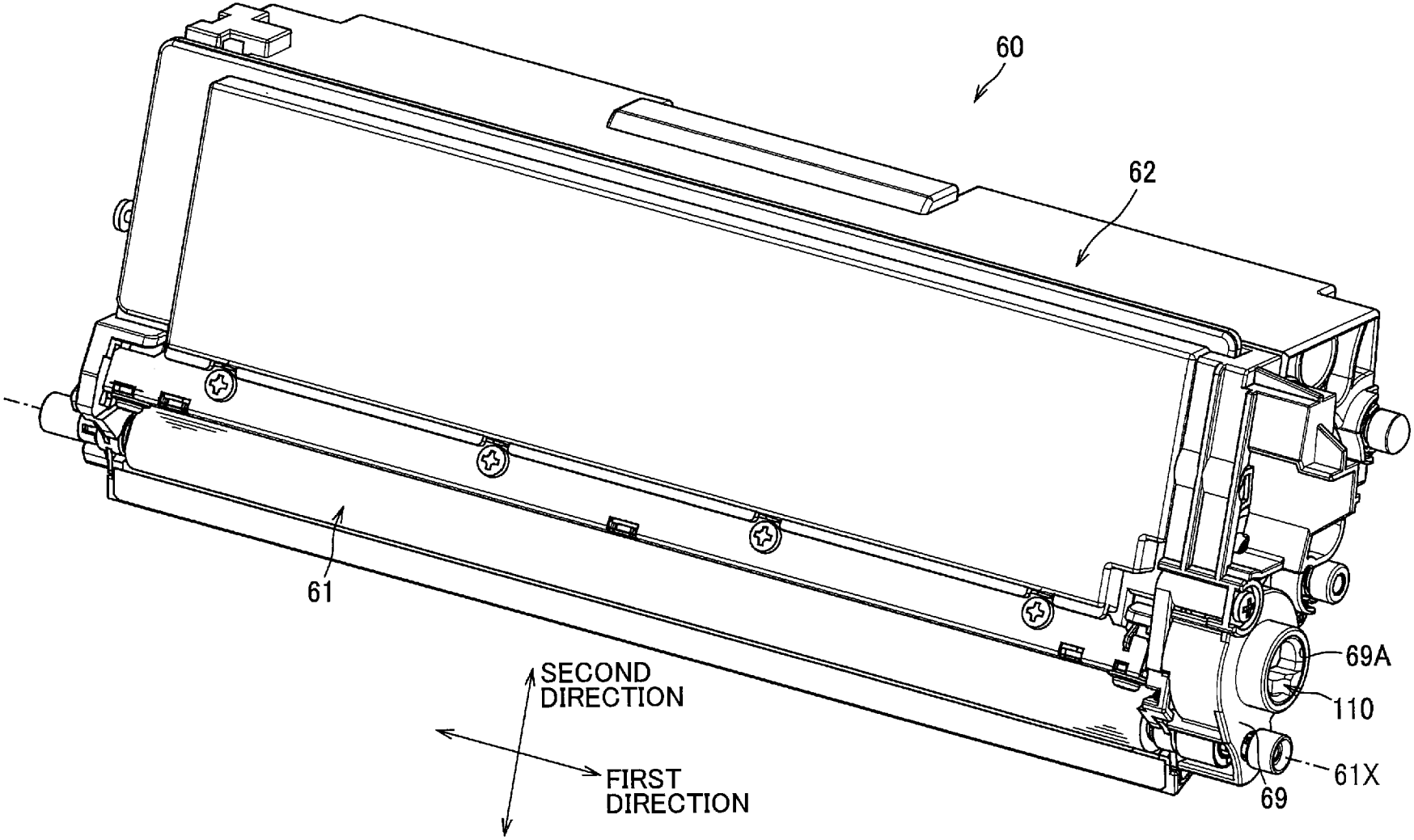
FIG. 2 is a perspective view of the developing cartridge according to the embodiment.

As illustrated in FIG. 2, each developing cartridge 60 includes a casing 62 for accommodating toner therein. The developing roller 61 extends in the first direction and is rotatably supported by the casing 62. A gear cover 69 is attached to a side surface of one side wall in the first direction of the casing 62. The gear cover 69 covers at least one gear. The gear cover 62 has a through-hole 69A. A coupling 110 is exposed to an outside of the gear cover 69 through the through-hole 69A. The coupling 110 is configured to rotate the developing roller 61. A drive shaft (not illustrated) of the image-forming apparatus 1 is connectable to the coupling 110.

Figure 3:
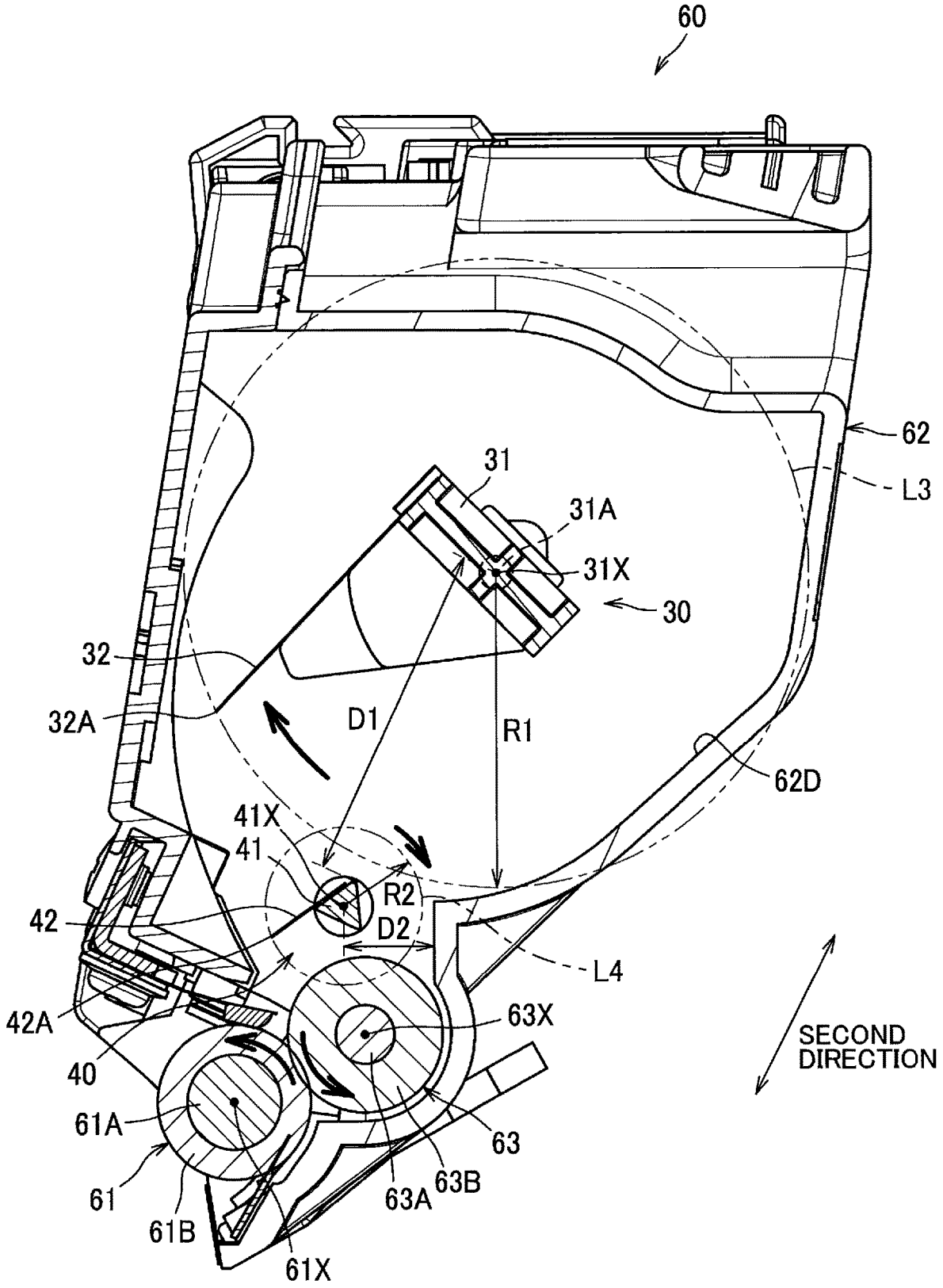
FIG. 3 is a cross-sectional view of the developing cartridge according to the embodiment.

As illustrated in FIG. 3, the developing cartridge 60 includes the developing roller 61, a supply roller 63, the first agitator 30, and a second agitator 40.

The developing roller 61 is positioned at one end portion of the casing 62 in the second direction. The developing roller 61 includes: a developing roller shaft 61A extending in the first direction; and a roller portion 61B disposed over a peripheral surface of the developing roller shaft 61A. The developing roller 61 is rotatable about the developing axis 61X extending in the first direction. The developing roller shaft 61A is made from metal. The roller portion 61B is made from electrically conductive rubber.

The supply roller 63 is rotatably supported by the casing 62 and is configured to supply toner to the developing roller 61. The supply roller 63 includes: a supply roller shaft 63A extending in the first direction; and a roller portion 63B disposed over a peripheral surface of the supply roller shaft 63A. The supply roller 63 is rotatable about a supply axis 63X extending in the first direction. The supply roller shaft 63A is made from metal. The roller portion 63B is made from sponge.

The first agitator 30 is rotatably supported by an approximately center portion of the casing 62, and is configured to agitate the toner in the casing 62. The first agitator 30 includes: a shaft 31 extending in the first direction; and a blade 32. The first agitator 30 is rotatable about a first agitator axis 31X extending in the first direction.

A support shaft portion 31A is provided at another end portion of the shaft 31 in the first direction to protrude therefrom. The casing 62 has an inner surface 62D. The support shaft portion 31A is supported by a recessed portion formed on the inner surface 62D of the casing 62. The shaft 31 of the first agitator 30 is made from resin.

The blade 32 of the first agitator 30 extends from the shaft 31 toward the inner surface 62D of the casing 62. The blade 32 has a tip end 32A configured to make sliding contact with the inner surface 62D. That is, the tip end 32A of the blade 32 of the first agitator 30 defines a rotation locus L3 which partially overlaps with the inner surface 62D of the casing 62. The blade 32 of the first agitator 30 is a flexible plate-like sheet, and is configured to flex upon contacting the inner surface 62D of the casing 62. The blade 32 is made from resin such as PET (polyethylene terephthalate).

The second agitator 40 is positioned between the first agitator 30 and the supply roller 63 in the second direction, and is configured to agitate the toner in the casing 62. The second agitator 40 includes: a shaft 41 extending in the first direction; and a blade 42. The second agitator 40 is rotatable about a second agitator axis 41X extending in the first direction.

The shaft 41 has a generally triangular cross-section. The blade 42 is affixed (adhesively bonded) to one surface of the triangle of the shaft 41. The blade 42 extends from the shaft 41 toward the inner surface 62D of the casing 62. The blade 42 is a film-like sheet having a flexibility, and is made from resin such as polyethylene terephthalate. The flexibility of the blade 42 is higher than a flexibility of the blade 32.

The shaft 41 is positioned outside of the rotation locus L3 of the first agitator 30. Specifically, the shaft 41 is positioned outside of the rotation locus L3 of the tip end 32A of the blade 32 of the first agitator 30. In other words, a distance D1 between the first agitator axis 31X and the shaft 41 is greater than a radius R1 of the rotation locus L3 of the first agitator 30.

The rotation locus L3 of the first agitator 30 is overlapped with a rotation locus L4 of the second agitator 40. That is, the blade 32 of the first agitator 30 is contactable with the blade 42 of the second agitator 40.

The blade 42 has a tip end 42A contactable with a peripheral surface of the supply roller 63. However, the tip end 42A of the blade 42 is out of contact with the inner surface 62D of the casing 62. That is, the tip end 42A of the blade 42 defines the rotation locus L4 that is positioned away from the inner surface 62D. In other words, a minimum distance D2 between the second agitator axis 41X and the inner surface 62D of the casing 62 is greater than a radius R2 of the rotation locus L4 of the second agitator 40. Hence, the tip end 42A of the blade 42 of the second agitator 40 contacts the peripheral surface of the supply roller 63 whereas the tip end 42A does not contact the inner surface 62D of the casing 62 in accordance with the rotation of the second agitator 40.

Figure 4:
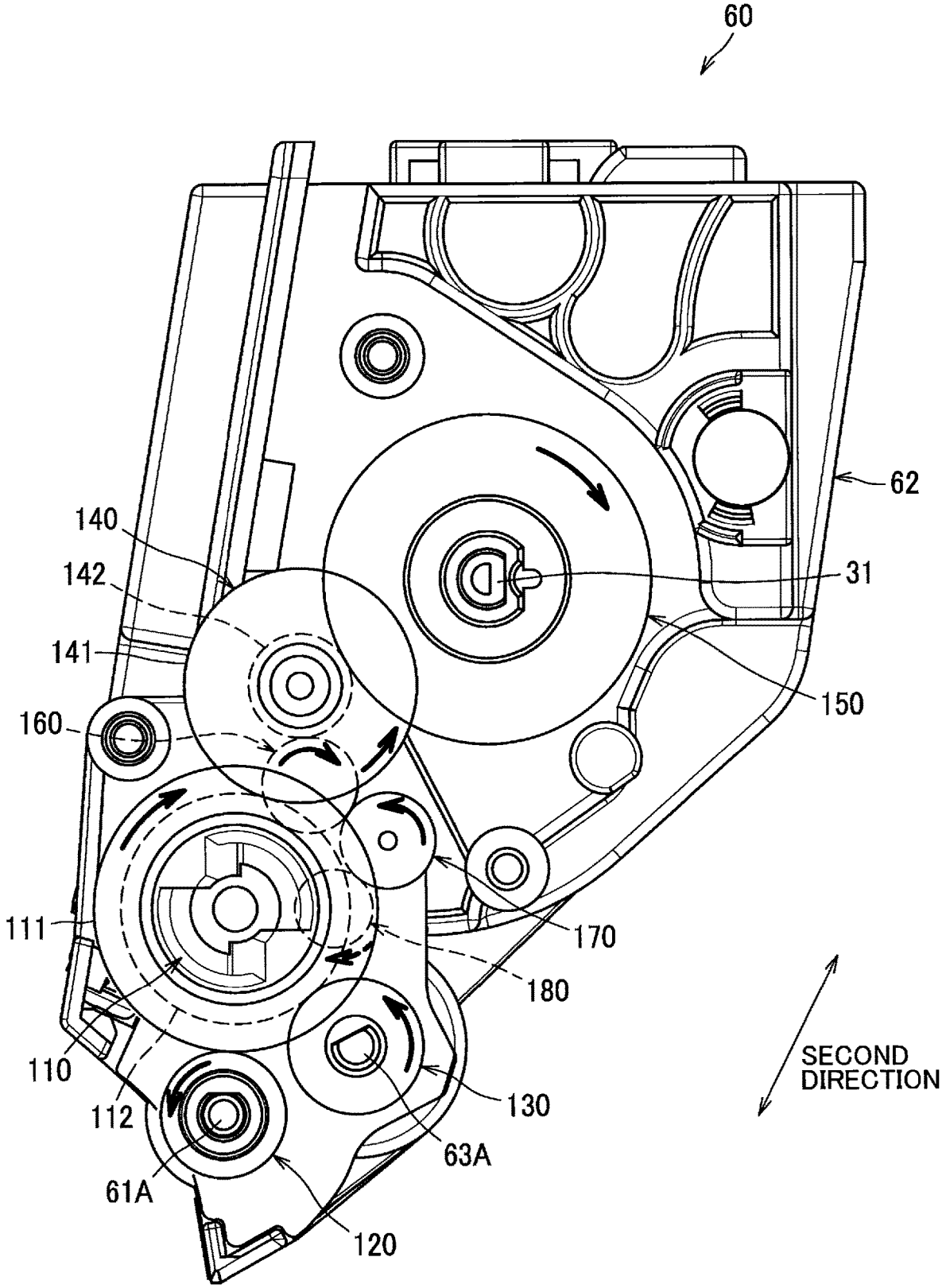
FIG. 4 is a side view of the developing cartridge according to the embodiment and illustrating a layout of gears in a state where a gear cover is removed.

As illustrated in FIG. 4, in the developing cartridge 60, the coupling 110, a developing gear 120, a supply gear 130, a first idle gear 140, a first agitator gear 150, a second idle gear 160, a third idle gear 170, and a second agitator gear 180 are provided at the one side surface in the first direction of the casing 62.

The developing gear 120 is attached to the developing roller shaft 61A. The supply gear 130 is attached to the supply roller shaft 63A. The first agitator gear 150 is attached to the shaft 31 of the first agitator 30. The second agitator gear 180 is attached to the shaft 41 of the second agitator 40.

The coupling 110 includes a large diameter gear 111 and a small diameter gear 112. The large diameter gear 111 is in meshing engagement with the developing gear 120. The small diameter gear 112 is in meshing engagement with the supply gear 130 and the first idle gear 140.

The first idle gear 140 includes a large diameter gear 141 and a small diameter gear 142. The large diameter gear 141 is in meshing engagement with the small diameter gear 112 of the coupling 110. The small diameter gear 142 is in meshing engagement with the first agitator gear 150 and the second idle gear 160.

The second idle gear 160 is in meshing engagement with the third idle gear 170. The third idle gear 170 is in meshing engagement with the second agitator gear 180. The second idle gear 160 and the third idle gear 170 are configured to transmit the rotation of the first idle gear 140 to the second agitator gear 180.

In accordance with the rotation of the coupling 110 upon receipt of the driving force from the drive shaft of the image-forming apparatus 1, the developing gear 120, the supply gear 130, and the first idle gear 140, which are in meshing engagement with the coupling 110, are caused to rotate. The rotation of the first idle gear 140 in turn causes the first agitator gear 150 and the second idle gear 160 those in meshing engagement with the first idle gear 140 to rotate. In response to the rotation of the second idle gear 160, the third idle gear 170 in meshing engagement therewith rotates. In response to the rotation of the third idle gear 170, the second agitator gear 180 rotates.

In the present embodiment, the developing roller 61 and the supply roller 63 respectively rotate in a counterclockwise direction in FIG. 4. The first agitator 30 and the second agitator 40 respectively rotate in a clockwise direction in FIG. 4. That is, the second agitator 40 rotates in the direction opposite to the rotation direction of the supply roller 63. Further, in the present embodiment, the number of rotations (rotation speed) of the second agitator gear 180 is greater than the number of rotations (rotation speed) of the first agitator gear 150 because of the difference in number of gear teeth.

Turning back to FIG. 3, the blade 42 of the second agitator 40 extending from the shaft 41 is directed toward upstream side in the rotating direction of the second agitator 40. That is, the blade 42 extends such that a direction from a base end thereof attached to the shaft 41 toward the tip end 42A follows the counterclockwise direction in FIG. 3. In other words, the tip end 42A of the blade 42 is positioned upstream relative to the base end of the blade 42 in the rotating direction of the second agitator 40.

With the developing cartridge 60 thus constructed, the following operational and technical advantages are attainable.

While the image-forming apparatus 1 is operating, the toner accommodated in the casing 62 of the developing cartridge 60 is supplied from the supply roller 63 to the developing roller 61. At this time, the toner in the casing 62 is agitated by the first agitator 30 and the second agitator 40 so as to avoid aggregation of the toner.

Aggregation of toner is likely to occur on the peripheral surface of the supply roller 63. Particularly, in the developing cartridge 60 configured to be attached to the image-forming apparatus 1 such that the developing roller 61 is positioned at a lower portion of the developing cartridge 60, since toner is compressed adjacent to the supply roller 63 due to the gravitational force, toner aggregation may occur on the peripheral surface of the supply roller 63.

In this connection, according to the developing cartridge 60 of the present disclosure, since the second agitator 40 is positioned between the first agitator 30 and the supply roller 63 and the tip end 42A of the blade 42 is configured to contact the peripheral surface of the supply roller 63, the blade 42 scrapes off the toner from the peripheral surface of the supply roller 63. Hence, aggregation of toner on the supply roller 63 can be restrained. Because of determent of occurrence of toner aggregation on the supply roller 63, movement of the aggregated toner toward the developing roller 61 can also be restrained, resulting in prevention of printing blur.

Further, according to the developing cartridge 60 of the present embodiment, damage to the blade 42 can be restrained, since the tip end 42A of the blade 42 does not contact the inner surface 62D of the casing 62.

Further, in the second agitator 40, the blade 42 extends from the shaft 41 toward the upstream side in the rotational direction of the second agitator 40. With this structure, the blade 42 is less likely to come off the shaft 41, compared to a structure where the blade 42 extends from the shaft 41 toward a downstream side in the rotational direction of the second agitator 40.

Further, since the blade 42 is shaped as a film-like sheet, the blade 42 can restrain aggregation of toner on the supply roller 63 without any damage to the supply roller 63.

Further, in the developing cartridge 60 according to the embodiment, the shaft 41 of the second agitator 40 is positioned outside of the rotation locus L3 of the first agitator 30. This structure can prevent mechanical interference between the shaft 41 and the first agitator 30.

Specifically, the shaft 41 is positioned outside of the rotation locus L3 provided by the tip end 32A of the blade 32 of the first agitator 30. Hence, mechanical interference between the shaft 41 of the second agitator 40 and the blade 32 of the first agitator 30 can be prevented.

Various modifications are conceivable.

For example, according to the above-described embodiment, the second agitator 40 includes only one single blade 42. However, the second agitator 40 may include a plurality of blades 42.

Figure 5A:
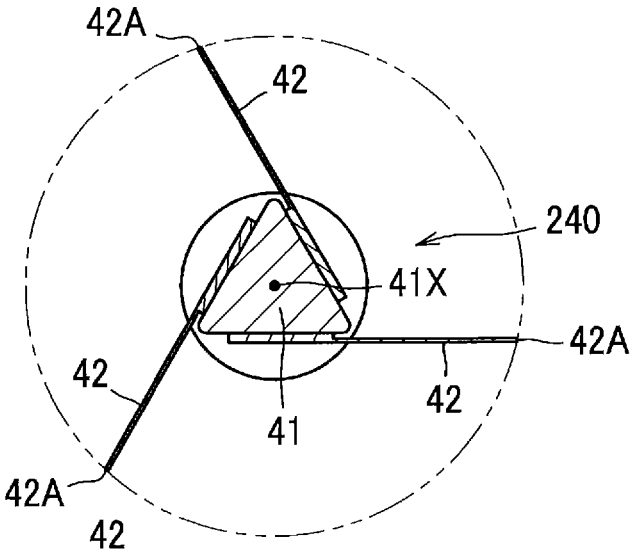
FIG. 5A is an enlarged cross-sectional views of a second agitator according to a first modification to the embodiment, wherein the second agitator includes: a shaft having a triangular cross-section; and three blades each extending from the shaft toward an upstream side in a rotational direction of the second agitator.

As an example, FIG. 5A illustrates a second agitator 240 according to a first modification to the embodiment. In the second agitator 240, one blade 42 is bonded to each surface of the triangular-shaped shaft 41. That is, the second agitator 240 includes three of the blades 42 in total. The tip end 42A of each blade 42 defines a distance from the second agitator axis 41X the same as one another among the three blades 42. Therefore, the tip ends 42A of the respective blades 42 can contact the peripheral surface of the supply roller 63. Due to the provision of the plurality of blades 42, even if one of the blades 42 is damaged, remaining blades 42 can keep scraping off the toner from the peripheral surface of the supply roller 63, thereby restraining the toner from being aggregated on the supply roller 63.

In the above-described embodiment, the shaft 41 of the second agitator 40 has a triangular cross-section. However, the shaft 41 of the second agitator 40 may have another shape such as a circular cross-section, for example. Still further, the shaft 41 may have a rectangular cross-section, as illustrated in FIGS. 5B though 5D.

Figure 5B:
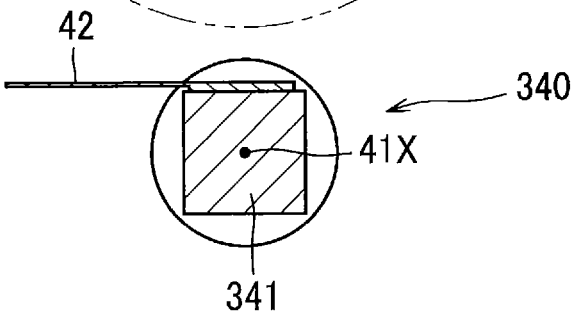
FIG. 5B is an enlarged cross-sectional views of a second agitator according to a second modification to the embodiment, wherein the second agitator includes: a shaft having a rectangular cross-section; and a single blade extending from the shaft toward an upstream side in a rotational direction of the second agitator.

More specifically, FIG. 5B illustrates a second agitator 340 according to a second modification to the embodiment. The second agitator 340 includes a shaft 341 having a rectangular cross section, and one single blade 42.

Figure 5C:
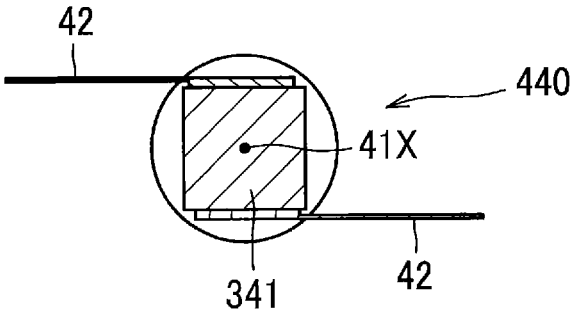
FIG. 5C is an enlarged cross-sectional views of a second agitator according to a third modification to the embodiment, wherein the second agitator includes: a shaft having a rectangular cross-section; and two blades each extending from the shaft toward an upstream side in a rotational direction of the second agitator.

FIG. 5C illustrates a second agitator 440 according to a third modification to the embodiment. The second agitator 340 includes the shaft 341 having a rectangular cross section, and two blades 42. The two blades 42 are affixed to a pair of opposite surfaces of the shaft 341 such that one blade 42 is bonded to one of the opposite surfaces. With this structure, there is no need to worry that one blade 42 may interfere with the other blade 42 when the one blade 42 is affixed to the opposite surface of the shaft 341.

Figure 5D:
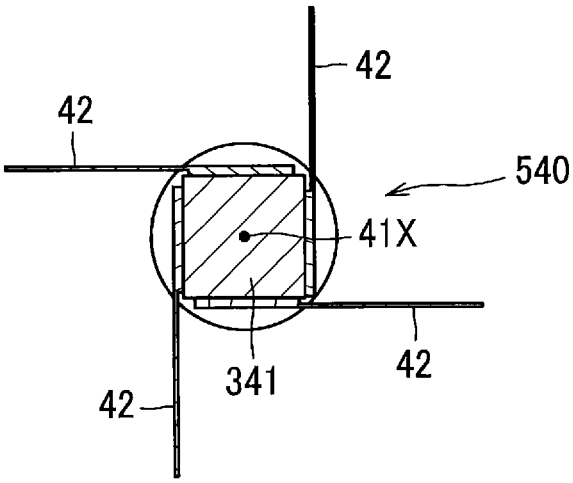
FIG. 5D is an enlarged cross-sectional views of a second agitator according to a fourth modification to the embodiment, wherein the second agitator includes: a shaft having a rectangular cross-section; and four blades each extending from the shaft toward an upstream side in a rotational direction of the second agitator.

FIG. 5D illustrates a second agitator 540 according to a fourth modification to the embodiment. The second agitator 540 includes the shaft 341 having a rectangular cross section, and four blades 42. In the second agitator 540, one blade 42 is affixed to each surface of the shaft 341.

According to the above-described embodiment, the blade 42 is affixed to the shaft 41. Alternatively, the blade 42 may be fixed to the shaft 41 by screws, for example. Still alternatively, one of the blade 42 and the shaft 41 may have a hole, and remaining one of the blade 42 and the shaft 41 may have a protrusion. The hole and the protrusion may be engaged with each other to fix the blade 42 to the shaft 41. Still alternatively, the shaft 41 may have a groove and the blade 42 may be fitted in the groove to fix the blade 42 to the shaft 41.

Figure 6:
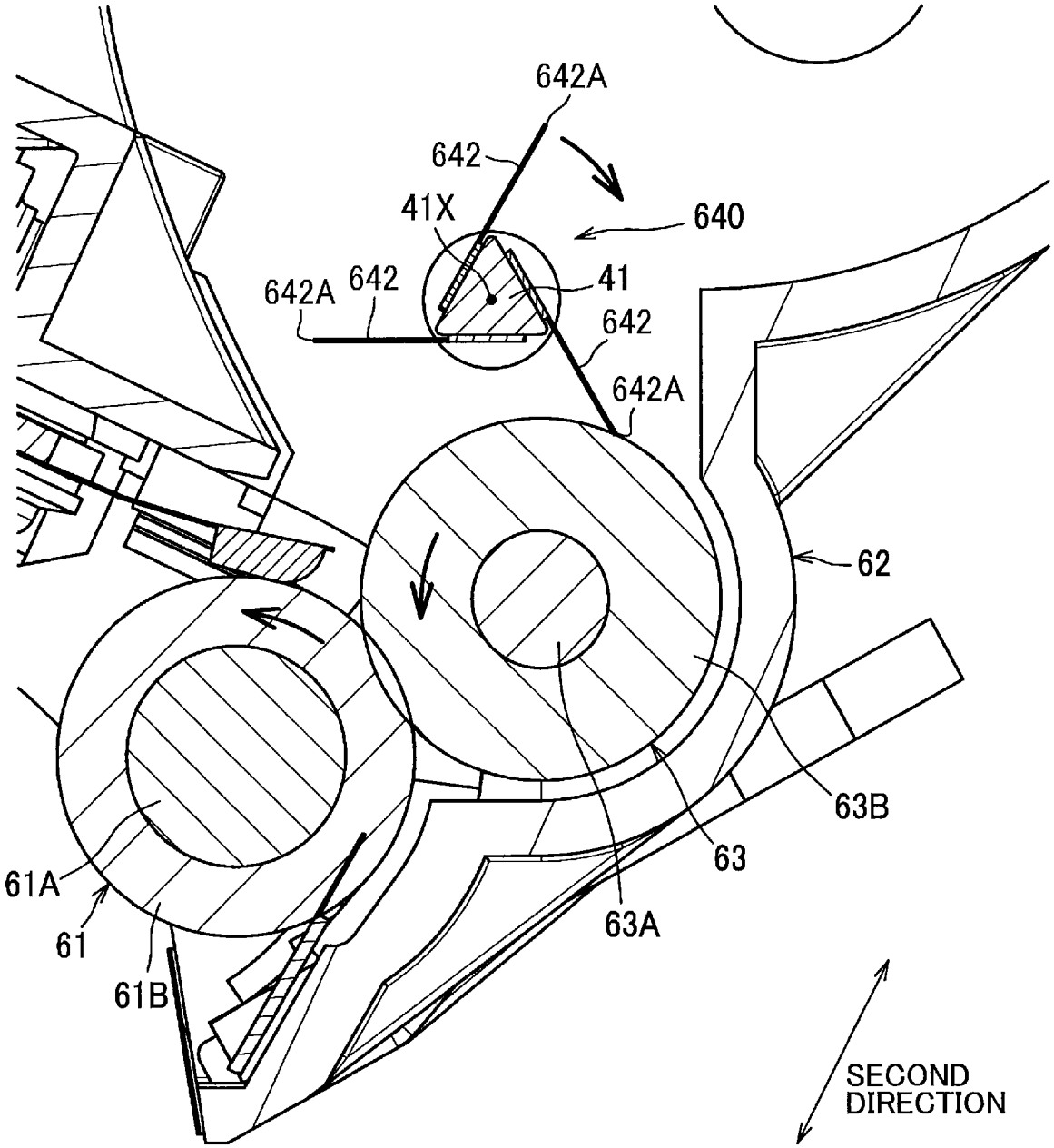
FIG. 6 is an enlarged cross-sectional view of a second agitator according to a fifth modification to the embodiment, wherein the second agitator includes: a shaft having a triangular cross-section; and three blades each extending from the shaft toward a downstream side in a rotational direction of the second agitator.

According to the above-described embodiment, the blade 42 extends from the shaft 41 toward the upstream side in the rotational direction of the second agitator 40. As an alternative structure, FIG. 6 illustrates a second agitator 640 according to a fifth modification to the embodiment. This second agitator 640 includes a plurality of blades 642 which extend from the shaft 41 toward a downstream side in the rotational direction of the second agitator 640. In this second agitator 640, the blades 642 may become easier to come off from the shaft 41, compared to the structure of the present embodiment where the blade 42 extends from the shaft 41 toward the upstream side in the rotational direction of the second agitator 40. However, toner scraping function in the second agitator 640 may be higher than toner scraping function of the second agitator 40.

Figure 7:
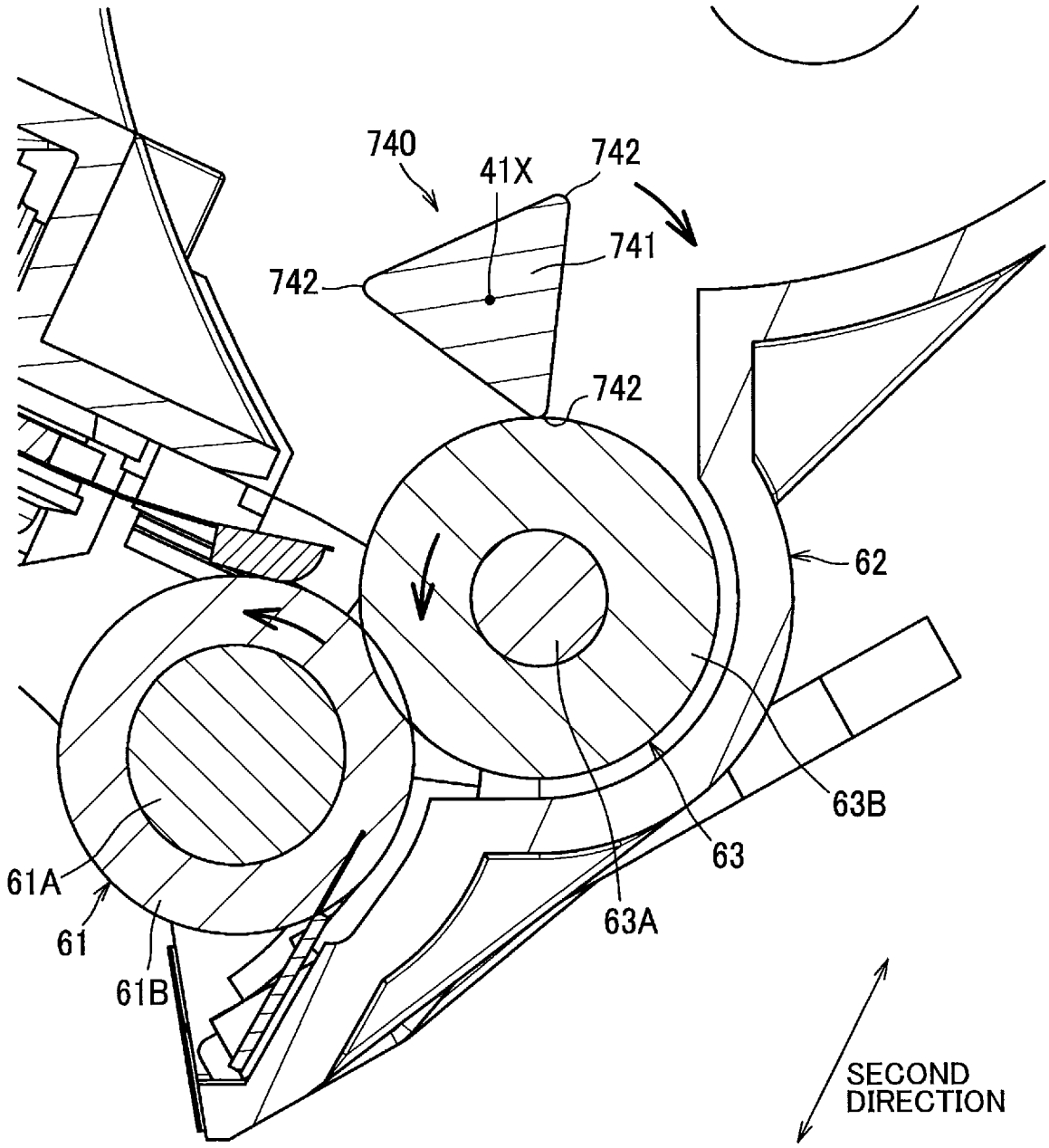
FIG. 7 is an enlarged cross-sectional view of a second agitator according to a sixth modification to the embodiment, wherein the second agitator includes a shaft and blades integrally formed with each other.

According to the above-described embodiment, the blade 42 is affixed to the shaft 41. In contrast, in a second agitator 740 according to a sixth modification illustrated in FIG. 7, blades 742 and a shaft 741 are integral with each other. The second agitator 740 has a triangular cross-section, and each apex of the triangle of the second agitator 740 functions as the blade 742 for scraping toner from the peripheral surface of the supply roller 63.

The developing cartridge 60 is employed as an example of a developing cartridge according to the disclosure. However, the present disclosure may be applied to a process cartridge where a developing cartridge and a drum unit are integral with each other. The present disclosure may also be applied to a developing device configured to receive toner from a toner cartridge storing the toner therein.

Every element described in the embodiment, modifications and variations may be combined with one another as appropriate.

While the description has been made in detail with reference to the embodiments, it would be apparent to those skilled in the art that many modifications and variations may be made thereto.

What is claimed is:

1. A developing cartridge comprising:

a casing configured to accommodate toner therein;

a developing roller rotatable about a developing axis extending in a first direction;

a supply roller rotatable about a supply axis extending in the first direction and configured to supply the toner to the developing roller;

a first agitator configured to agitate the toner in the casing; and a second agitator rotatable about a second agitator axis extending in the first direction and configured to agitate the toner in the casing, the second agitator being positioned between the first agitator and the supply roller, the second agitator including a blade having a tip end configured to contact a peripheral surface of the supply roller.

2. The developing cartridge according to claim 1, wherein the tip end of the blade of the second agitator does not contact an inner surface of the casing.

3. The developing cartridge according to claim 1, wherein the second agitator includes a plurality of the blades, the tip end of each blade being configured to contact the peripheral surface of the supply roller.

4. The developing cartridge according to claim 1, wherein the blade is in a form of a film-like sheet.

5. The developing cartridge according to claim 4, wherein the second agitator further includes a shaft, the film-like sheet extending from the shaft in an upstream side in a rotational direction of the second agitator.

6. The developing cartridge according to claim 1, wherein the second agitator further includes a shaft positioned outside of a rotation locus of the first agitator.

7. The developing cartridge according to claim 6, wherein the first agitator includes a blade having a tip end;

wherein the shaft is positioned outside of a rotation locus of the tip end of the blade of the first agitator.

8. The developing cartridge according to claim 6, wherein the shaft has a triangular cross-section.

9. The developing cartridge according to claim 6, wherein the shaft has a rectangular cross-section.

10. The developing cartridge according to claim 1, wherein the second agitator is rotatable in a rotating direction opposite to a rotating direction of the supply roller.

11. The developing cartridge according to claim 1, wherein the first agitator is rotatable about a first agitator axis extending in the first direction.

12. The developing cartridge according to claim 1, wherein the developing roller is positioned at one end portion of the casing in a second direction crossing the first direction.

13. The developing cartridge according to claim 12, wherein the second direction is perpendicular to the first direction.

14. The developing cartridge according to claim 12, wherein the second agitator is positioned between the first agitator and the supply roller in the second direction.

15. The developing cartridge according to claim 1, wherein the developing roller is rotatably supported by the casing, wherein the supply roller is rotatably supported by the casing, wherein the first agitator is rotatably supported by the casing, and wherein the second agitator is rotatably supported by the casing.

* * * * *